US010167617B2

(12) United States Patent
Hall et al.

(10) Patent No.: US 10,167,617 B2
(45) Date of Patent: Jan. 1, 2019

(54) MODULAR TOILET SYSTEM AND COMPONENTS

(71) Applicants: David R. Hall, Provo, UT (US); Dan Allen, Springville, UT (US); Jared Reynolds, Pleasant Grove, UT (US); Joshua Larsen, Spanish Fork, UT (US); Joe Fox, Spanish Fork, UT (US)

(72) Inventors: David R. Hall, Provo, UT (US); Dan Allen, Springville, UT (US); Jared Reynolds, Pleasant Grove, UT (US); Joshua Larsen, Spanish Fork, UT (US); Joe Fox, Spanish Fork, UT (US)

( * ) Notice: Subject to any disclaimer, the term of this patent is extended or adjusted under 35 U.S.C. 154(b) by 0 days.

(21) Appl. No.: 15/814,721

(22) Filed: Nov. 16, 2017

(65) Prior Publication Data

US 2018/0073234 A1 Mar. 15, 2018

Related U.S. Application Data

(62) Division of application No. 15/213,774, filed on Jul. 19, 2016, now Pat. No. 9,845,593.

(60) Provisional application No. 62/288,949, filed on Jan. 29, 2016, provisional application No. 62/250,262, filed on Nov. 3, 2015.

(51) Int. Cl.

| | |
|---|---|
| ***E03D 11/18*** | (2006.01) |
| ***E03D 11/06*** | (2006.01) |
| ***E03D 11/02*** | (2006.01) |
| ***E03D 11/13*** | (2006.01) |

(52) U.S. Cl.

CPC ..... *E03D 11/06* (2013.01); *E03D 11/02* (2013.01); *E03D 11/135* (2013.01); *E03D 11/18* (2013.01); *E03D 2201/30* (2013.01); *E03D 2201/40* (2013.01)

(58) Field of Classification Search

CPC ..... E03D 11/08
USPC ..... 4/422–430
See application file for complete search history.

(56) References Cited

U.S. PATENT DOCUMENTS 9,845,593 B2 * 12/2017 Hall ..... E03D 11/06

* cited by examiner

*Primary Examiner* — Lori Baker

(57) ABSTRACT

A modular toilet is disclosed comprising a toilet shell and a hydraulic core. The hydraulic core module is a separate unit from the toilet shell module and may be non-symmetrical with the internal and external form of the shell. The core module comprises a toilet bowl connected to a siphon drain comprising a weir. The drain may be a vertical loop drain. The toilet shell and the hydraulic core may comprise mutual sealing surfaces. The drain may comprise openings for connection to a toilet ventilation system.

12 Claims, 7 Drawing Sheets

MODULAR TOILET SYSTEM AND COMPONENTS

CROSS REFERENCE TO RELATED APPLICATIONS

This application is a division of co-pending U.S. patent application Ser. No. 15/213,774 filed on Jul. 19, 2016 which claims priority to U.S. Provisional Patent Applications Nos. 62/250,262, filed Nov. 3, 2015, entitled Toilet Hydraulic Core Module and 62/288,949, filed Jan. 29, 2016, entitled Ventilated Toilet with P-Trap Flow Control, each of which are hereby incorporated by reference in their entirety.

FIELD OF THE INVENTION

The present invention relates generally to the field of toilet systems, and more particularly to modular toilets having a separate shell and hydraulic core.

BACKGROUND OF THE INVENTION

In addition to the function of waste removal, toilet systems are now being designed to analyze waste products for the purpose of providing health metrics. This generally requires modifications to the toilet which are difficult to manage with porcelain. Glazed vitreous porcelain has excellent strength and chemical resistance; however, it has a brittle nature and poor wall thickness and flatness tolerances. Also, the inherent shrinkage in the green ceramic, the numerous design constraints surrounding complex fluid flow pathways, and the location and kind of holes and other features desired in the modern toilet require multiple manufacturing steps, including the assembly of multiple discrete pre-molded components. Furthermore, finishing porcelain fixtures produces hazardous dust particles. After firing, machining of the ceramic toilet is only possible with diamond tooling at high expense and considerable difficulty. Furthermore, when the existing ceramic toilet is a unitary structure it is bulky and can only be serviced by complete replacement, whereas the first portion of a toilet to degrade may be only the bowl appearance.

Accordingly, there is a need for a more flexible manufacturing solution that allows easy integration of technology features including health diagnostics and more efficient water conservation, as well as being easily adaptable to a variety of settings and upgradable, and amenable to replacement and updating of components.

The toilet system of the present invention allows for greater variety in toilet manufacturing processes, installation, personal accommodations, and utility beyond waste disposal. The invention disclosed herein further allows the separate replacement of the hydraulic core module or the shell module independently at substantially lower cost.

SUMMARY

In one aspect, the present invention relates to a modular toilet system, comprising a toilet shell comprising an opening, and a hydraulic core comprising a bowl integrated with a siphon system having a weir, wherein the toilet shell and the hydraulic core are independent structures and the hydraulic core bowl is configured to fit within and seal with the toilet shell opening such that the toilet shell opening opens to the hydraulic core bowl.

In another aspect, the invention comprises the toilet shell comprising an opening having a sealing surface configured to mate with a separate toilet hydraulic core bowl to form a water tight seal between the toilet shell and the hydraulic core comprising a siphon system and a weir.

In yet another aspect, the invention comprises the hydraulic core comprising a bowl integrated with a siphon system having a weir, wherein the hydraulic core bowl comprises an opening having a sealing surface configured to mate with a toilet shell sealing surface to form a water tight seal between the hydraulic core bowl and the toilet shell.

In some embodiments, the toilet shell opening comprises a first sealing surface that extends around a circumference of the toilet shell opening, and the hydraulic core bowl comprises a second sealing surface that extends around a circumference of the hydraulic core bowl, wherein the first sealing surface mates with the second sealing surface to form a water tight seal.

In other embodiments, the weight of the toilet shell causes the toilet shell sealing surface to compress against the hydraulic core bowl sealing surface.

In yet other embodiments, the hydraulic core bowl comprises a lip configured to mate with a channel on an inner portion of the toilet shell.

In still other embodiments, the channel comprises an acute angle shaped space and the hydraulic core comprises a mating acute angle shaped protrusion, wherein the channel is configured to force the hydraulic core lip upward toward a lower surface of the toilet shell such that the hydraulic core bowl seals with the toilet shell opening.

In some embodiments, the toilet shell is connected to a controllable water supply and the hydraulic core is connected to a sewer.

In some other embodiments, the hydraulic core is configured to be supported independent of the toilet shell.

In one embodiment, the toilet shell first sealing surface and the hydraulic core bowl second sealing surface are horizontal.

In other embodiments, one or more sensor is disposed within the hydraulic core bowl.

In other embodiments, the hydraulic core siphon system comprises a helical loop trap way having substantially monotonic helicity.

BRIEF DESCRIPTION OF THE DRAWINGS

The present invention is illustrated and described in reference to the accompanying drawings in which.

Figure 1:
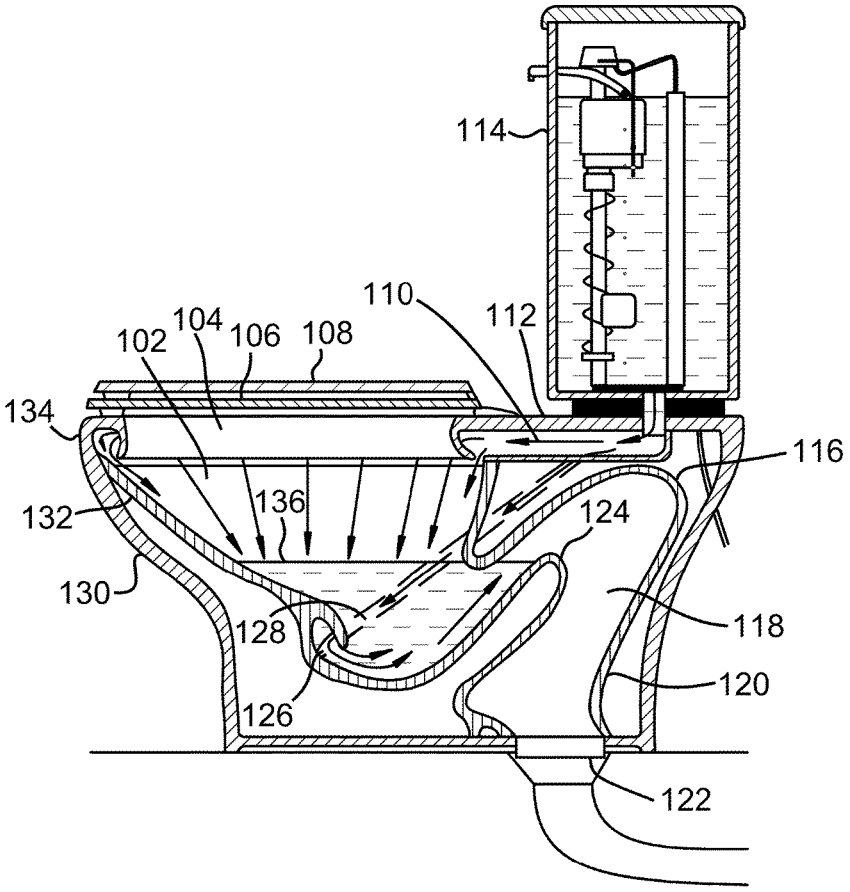
FIG. 1 is a side view of a discrete modular hydraulic core comprising a toilet bowl and a tubular P-trap style drain having a weir and a spillway

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The skilled artisan will understand, however, that the apparatuses, systems and methods described below can be practiced without employing these specific details, or that they can be used for purposes other than those described herein. Indeed, they can be modified and can be used in conjunction with products and techniques known to those of skill in the art in light of the present disclosure. The drawings and descriptions are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

The present invention relates to a modular toilet system comprising a toilet shell (referred to herein as the "shell") and a hydraulic core. The hydraulic core and the toilet shell are independent structures, and the hydraulic core may be non-symmetrical with the internal and external form of the shell. The toilet shell may be serviceable and replaceable independent of the hydraulic core and vice versa. The core's bowl and siphon may be replaceable separate from each other.

The hydraulic core comprises a bowl that is integrated with a siphon system having a weir (i.e., a P-trap) that is connected to and empties into a sewer system. The hydraulic core may, in some embodiments, include such additional features as a high-pressure jet, and a sump.

The toilet shell houses the hydraulic core and includes an opening that opens to the opening of the hydraulic core bowl. In some embodiments the toilet shell may further include a water tank for providing the hydraulic flush needed to remove the waste contents from the hydraulic core. The toilet shell module may be mounted on the hydraulic core. Alternatively, when the shell is attached to a mounting surface, such as a floor or a wall, the hydraulic core may be positioned inside the shell. The high-pressure jet may comprise a replaceable, variable jet nozzle. The hydraulic core and the shell comprise means for mutual attachment and mating seal surfaces to prevent leaks and maintain hydraulic integrity. In an embodiment, the hydraulic core bowl is configured to fit within and seal with the toilet shell opening such that the toilet shell opening opens to the hydraulic core bowl. The hydraulic core may also comprise materials and properties differing from those of the toilet shell.

This present invention provides a modular toilet comprising two or more units of plastic, fiberglass, carbon fiber, metal, ceramic, or combinations thereof: a shell module and a hydraulic core comprising a bowl and a serpentine siphon comprising a sump and a weir. The siphon flow pathway, or P-trap pipe, may be either integral with the bowl or separate allowing for differences in desired material properties, hydraulics, and applications in order to accommodate personal preferences, aesthetic, environmental, or ambient conditions. The modular toilet may make use of different materials for each modular portion of the toilet, such as hard-coated plastic or metal, metal, fiberglass, microfibers, composites, ceramic, or combinations thereof. Portions may be manufactured from the most suitable or available material and replaced as needed. The toilet shell module may have a shape, for instance, like a skirted toilet, where the skirt does not conform to the shape of the hydraulic core or piping.

The shell module and the core module may be suitable for different styles of toilets, including but not limited to, floor mounted toilets and urinals, wall mounted toilets and urinals, and floor and wall mounted bidets, or combinations thereof. Also, although the embodiments disclosed herein are directed primarily toward a hydraulic core comprising a bowl and a siphon, the features of the present invention may be equally applicable to modular toilet systems comprising a shell and a hydraulic core bowl.

The hydraulic core may comprise a siphon jet assist comprising a replaceable, variable jet nozzle. The nozzle may be configured to produce a swirling stream of water into the siphon. The high-pressure jet may be separately connected to an ambient water source. The water source for the bowl may be from the tank while the water source for the jet may be directly from the water source's supply line. The hydraulic core module may comprise bowl hydraulic ports comprising replaceable, directional hydraulic nozzles.

In some embodiments, the toilet shell opening comprises a first sealing surface that extends around a circumference of the toilet shell opening, and the hydraulic core bowl comprises a second sealing surface that extends around a circumference of the hydraulic core bowl, wherein the first sealing surface mates with the second sealing surface to form a water tight seal.

In some embodiments, the weight of the toilet shell causes the toilet shell sealing surface to compress against the hydraulic core bowl sealing surface. For example, the height of the toilet shell from its base to the sealing surface may be less than the height of the hydraulic core sealing surface to its base, such that the toilet shell sealing surface is fully weighted on the hydraulic core sealing surface.

In another embodiment, the toilet shell sealing surface and the hydraulic core bowl sealing surface are mated by means of a lip on the hydraulic core that fits within a channel within the toilet shell. For example, the hydraulic core bowl may comprise a lip that is configured to mate with the channel on an inner portion of the toilet shell, wherein the acute angle shaped space is configured to force the hydraulic core lip upward toward a lower surface of the toilet shell such that the hydraulic core bowl seals with the toilet shell opening. The channel on the inner portion of the toilet shell may comprise, for example, an acute angle shaped space that wedges the toilet shell into place over the hydraulic core. In another embodiment, where the toilet seal and the hydraulic core seal are horizontally oriented, the acute angle shaped space may have one surface of the angle horizontal and the other surface of the angle non-horizontal, such that the non-horizontal surfaces of the lip and the channel of the toilet shell and the hydraulic core engage and cause the horizontal surfaces to come together and seal. Thus, in some embodiments, the shell front has a socket or open-mouthed feature into which the lip of the bowl is jammed to form a tight seal. Thus, the front of the bowl can be anchored with "forward" force rather than "upward" force with bolts near the front which would be inaccessible. The bowl has a built-in wedge shape lifting to the front slightly, such that as the shell is tightened down or back the plastic bowl conforms, by flexing, to provide a tight seal at the front where the user can't reach back to tighten screws to hold the bowl against the shell. The weight of the porcelain shell may with this configuration provide a compression seal on the bowl.

The toilet of this invention comprises the following features. The utility of the toilet may be varied by features installed or omitted from the shell or the hydraulic core. For example, sensors for detecting ambient conditions, toilet performance, and user personal health and hygiene may be installed in the modules of this disclosure. The toilet shell and the hydraulic core may comprise a metal, a plastic, or both, or a nano-ceramic coated plastic or metal that has the appearance of porcelain and is hydrophobic. The modularity allows for tighter manufacturing tolerances on smaller pieces and separate manufacturing of toilet components, which may individually be replaceable at a lower cost compared to replacement of an entire toilet system. The core module does not have to be removed to dispose of user waste, like hospital toilets with replaceable bowls—a key difference of the modular plumbed toilet core to a hospital bed pan built into a chair.

The toilet shell and the hydraulic core may have features like physical generators and sensors, urinalysis sensors, flow meters, capacitance flow meters, overflow sensors, litmus test materials, sonic sensors, ultrasonic sensors, infrared sensors, ultraviolet sensors, x-ray sensors, fiber optic sensors, electromagnetic sensors, magnet resonance imaging sensors, ultra-sound sensors, lasers, thermocouples, thermometers, thermo-sensors, scales, accelerometers, vibration generators, gas sensors, light emitting diodes, batteries, monitors, digital readouts, deodorizers, fans, exhaust pathways, jets, nozzles, bidets, seals and sealing surfaces, and means for attachment.

The toilet of the present invention may comprise a ceramic porcelain toilet shell with a tank but no core, but with seal surfaces and attachment fixtures to receive a core, the core not being removable unless the shell is removed. A ceramic porcelain toilet shell can be removed by disconnecting it from anchor points to the floor or the hydraulic core assembly and pulled forward to reveal the core assembly, the core assembly being anchored to the floor or sewer connection and providing the seal to the sewer. (e.g., not a removable core, but a removable shell).

The modular toilet shell and the hydraulic core are further supported by any of the following features, components, and processes. The shell, if ceramic, may be designed in such a way that it is self-supporting during firing as the bowl plays a role in supporting the ceramic shell during firing. It may contain a bowl-like shape that is deeper than the plastic bowl to be inserted, the bowl-like porcelain shape providing strength during and after firing.

The seal between the bowl and the shell may comprise a low temperature adhesive which may permit separation of the toilet shell and the hydraulic core through use a heat gun. Alternatively, the seal in the form of a liquid, tape, or O-ring between the bowl and shell may comprise an elastomer, perfluoroelastomer, buta-n-nitrile, hydrogenated nitrile, fluorocarbon, TFE/P, Viton, silicone, fluorosilicone, rubber, synthetic rubber, EPDM, neoprene, polyurethane, PTFE, or Teflon. The seal of the toilet shell/bowl joint may also comprise a nano-ceramic coating. In other embodiments, the seal of the bowl-shell joint may be covered with a thin layer of UV or blue-cured ceramic composite (like a dental coating). In some embodiments, the bowl or ceramic has a built-in heater wire to melt the thermal adhesive for bonding-debonding. In other embodiments, the bowl or ceramic has a UV-degrading adhesive that can be broken down by UV irradiance, e.g. by a UV gun or UV transmissive, diffusing fiber built into the seal.

The means for attachment of the core module to the shell module may comprise clamps, screws, adhesives, compression fit, compression fittings, buckles, grommets, rivets, pins, anchors, retaining rings, snap rings, O-rings, protrusions, snaps, key-hole fasteners, etc.

In addition, the hydraulic core may further comprise a toilet drain configuration comprising a helical loop trapway. In some configurations, the helical loop trapway may exit the toilet bowl from the side, which allows for a toilet having an out-of-plane flush jet opposite the entrance port for the helical loop trapway. The water from the flush jet enters the bowl substantially out-of-plane, for example from the right side, and exits the bowl via the modified helical loop trapway design that is substantially out-of-plane and opposite the jet.

This fundamental design change enables a host of beneficial design options. First, the water from the tank goes through a minimum of impeding bends, for instance bending only 90 degrees from the bottom of the tank to the side of the bowl. The quarter-bend turn may have a larger radius relative to the length of the pipe section compared to designs that have to bring the water from the tank in the back to the jet entrance at the front (a 180-degree bend). The shorter bend and distance allows the flush jet water to transit quickly from the tank (or other reservoir or pressure system) losing a minimum of momentum. Additionally, the diameter of the pipe may be large, as it is out-of-plane and does not need to be monolithic with the toilet bowl.

On the downstream side of the bowl, the flush system may form a trapway with a bend of substantially monotonic helicity. The axis for which the trapway has the general structure of a corkscrew, the pipe forming a section of loop-de-loop. Downstream of the trap there may be deviations from the monotonic helicity, but in the vicinity of the trap the pipe bends does not change the sign of its curvature. Essentially the trapway may be formed from approximately a section of a torus (pipe bent into portion of a circle). This is radically different from traditional traps that bend alternately up and then down in different directions.

The high-speed injection of flush jet water allows for a siphon flush with a larger trapway pipe, offering with less impedance. The looping trapway provides a minimum of resistance and allows objects transiting the trapway to continue in a quasi-laminar flow, reducing the likelihood of a clog. For example, compliant waste products such as feces may bend in the trapway to accommodate the pipe curvature. Because the pipe bend does not change many times, the feces may be more likely to transit without obstruction, relative to a design which forces the feces and other flush material to bend alternately one direction and then the other. The angular momentum of the flushing matter is significantly maintained through the trap. A toilet with a skirted design can hide the out-of-plane flush jet pipe and trapway from the user, offering a smooth continuous outer surface for the toilet.

The attached drawings, discussed below, illustrate embodiments of the present invention.

FIG. 1 shows a toilet generally related to the field of the present invention. The invention disclosed herein may relate to additional toilet systems such as urinals, wall mounted systems, and systems without hydraulic siphons. The toilet system of FIG. 1 shows a flush style syphonic toilet system, including a toilet bowl, hydraulic jet, hydraulic siphon system, and a controllable water supply tank. The toilet comprises a controllable water source connected to a toilet stool comprising an integral bowl, high pressure jet, and siphon. As shown in FIG. 1, the toilet comprises a water tank 114 mounted on a toilet stool 112/134. The toilet stool 112/134 comprises a toilet bowl 102, a toilet bowl rim 104, a toilet seat 106, and a toilet seat lid 108. The toilet further comprises a flush water channel 110 running through the rim 104 and a jet water channel 128 for delivering water to the bowl jet 126. The toilet bowl further comprises a P-trap style tubular drain generally at 124, 118 comprising a weir 124 and a spillway 118. The drain is connected to a sewer 122. The static water level 136 in the bowl is proximate the crest of the weir 124. The hydraulic jet 126 is proximate and directed into the mouth of the drain.

FIG. 1 also shows a discrete modular hydraulic core or circuit 132 comprising a toilet bowl 102 and a tubular P-trap style drain 116, comprising a weir 124 and a spillway 118 adapted for connection to a sewer 122. The hydraulic core 132 further comprises a bowl jet 126 for delivering a high-pressure stream of water into the P-trap 116. The bowl jet 126 may be adjacent an opening of the P-trap or within the opening of the P-trap. It may be desirable to place the jet further inside the tubular portion of the P-trap. The discrete hydraulic core 132 may be inserted into a toilet stool shell 112 as depicted in FIG. 1. The core 132 is replaceable apart from the stool shell and may accommodate a variety of stool shell configurations. The core 132 may comprise a ceramic or porcelain material or a non-ceramic or porcelain material, such as glass, a natural or synthetic rubber, silicone, plastic, carbon fibers, iron, steel, stainless steel, titanium, brass, copper, wood, fiberglass, or a composite of such materials. The core 132 may be formed by a variety of manufacturing process, such as blowing, molding, casting, or machining appropriate to the nature of the material being used. The interior surfaces of the core 132 may be highly polished or treated with a hydrophobic coating. The interior surfaces of the P-trap 116 may comprise shapes that promote the hydraulic syphonic flow toward the sewer 122.

Figure 7:
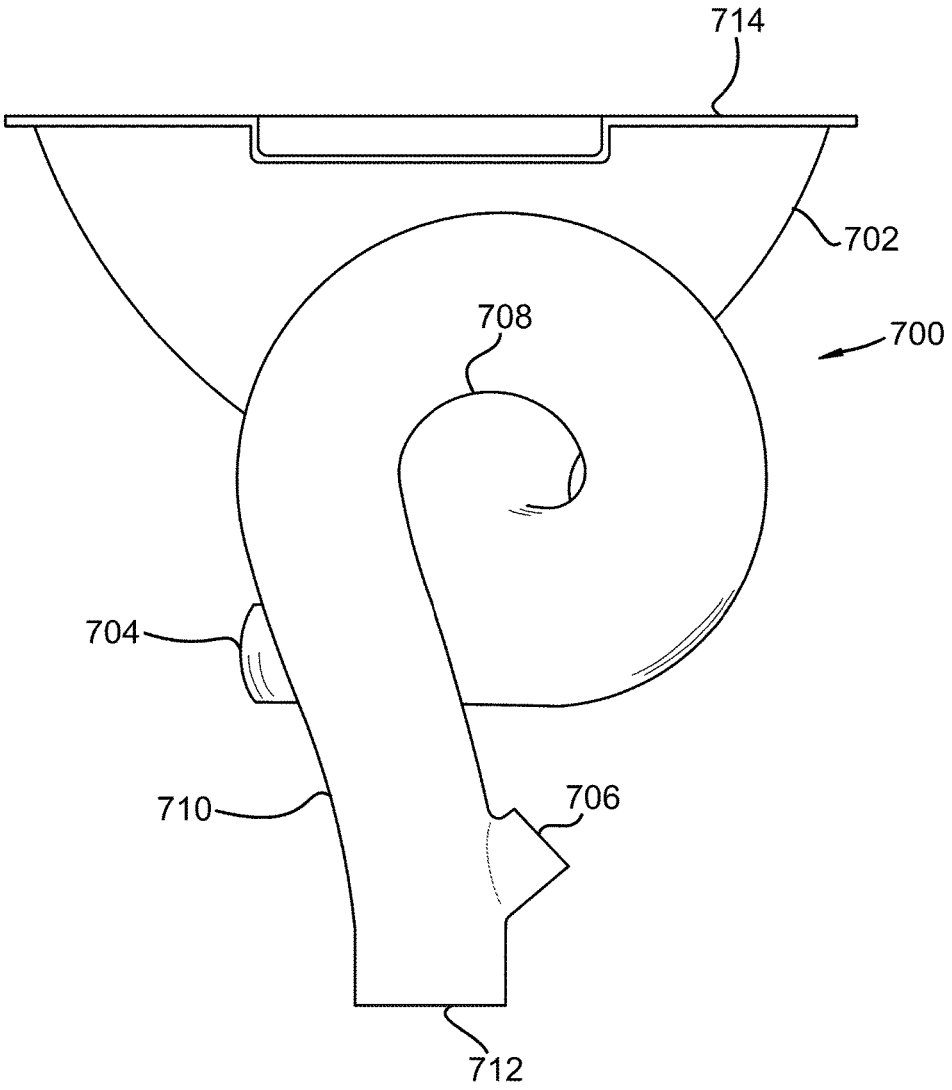
FIG. 7 is a rear view of a hydraulic core drain having monotonic helicity.

FIG. 1 further shows the discrete modular hydraulic core 132 (indicated by vertical cross hatching) inserted into a toilet stool shell 112/134 (indicated by angled cross hatching). The hydraulic core 132 comprises a P-trap style drain 116/120 extending from the toilet stool 112 or toilet bowl 102. The modular toilet system of the present invention may comprise any one of various types and configurations of a P-trap style drain. FIG. 1 shows one possible type of P-trap style drain. FIG. 7 shows another possible configuration of a P-trap style drain, in which the drain comprises a P-trap having monotonic helicity.

Figure 2:
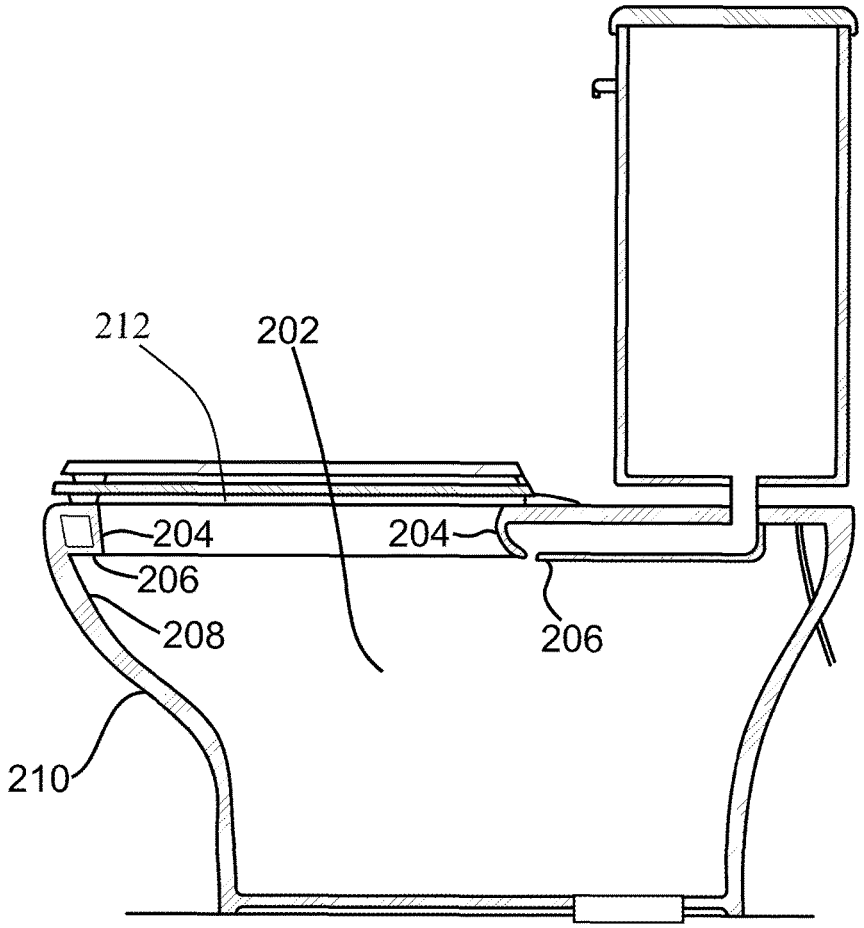
FIG. 2 is a side view of a toilet shell.
Figure 3:
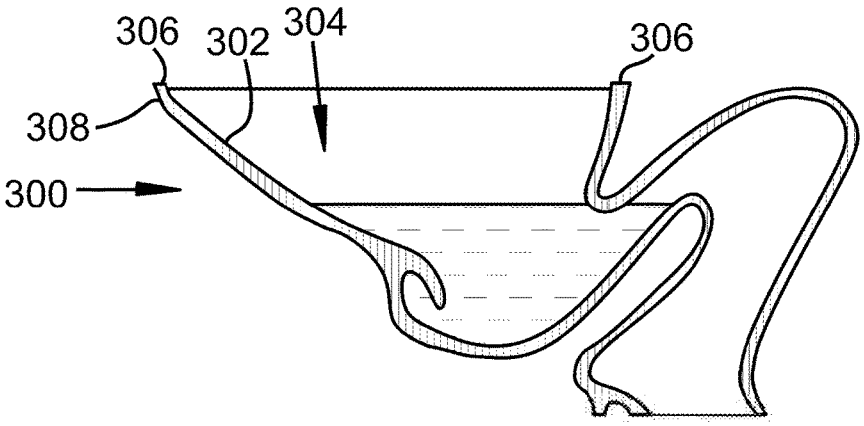
FIG. 3 is a side view of a hydraulic core.

FIG. 2 and FIG. 3 are diagrams of the toilet in accordance with the present invention, separated into the two major components—the toilet shell (FIG. 2) and the hydraulic core module (FIG. 3). Not shown, but present in the core module, is a high-pressure jet directing a water stream into the siphon. Each of the shell module and the core module are separable and separately serviceable. Although the shell and core may be made of ceramic, it may be preferable that they are made from materials that readily accept post manufacturing modification and service as described herein.

FIG. 2 depicts a toilet shell 210 separated from the hydraulic core module 300 (FIG. 3). The toilet shell 210 and the hydraulic core 300 are independent structures, wherein the hydraulic core 300 is configured to be sized to fit within and seal with the toilet shell 210, such that the opening 212 of the toilet shell opens to and is above the hydraulic core bowl 304 The toilet shell 210 functions as an outer shell that encompasses and covers the hydraulic core module 300—thus, the hydraulic core module 300 fits within the toilet shell 210. FIGS. 2 and 3 each show the principal features of the present invention, as discussed below.

The toilet shell 210 includes an opening 204/212 that opens downwardly into the bowl 304 of the hydraulic core 300, which bowl also has an opening 304 for receiving human waste products. The toilet shell further comprises a sealing surface 206/208 that mates with a corresponding sealing surface 306/308 of the hydraulic core 300, discussed below. The sealing surface 206/308 is generally disposed around the circumference of the bottom and/or side of the rim 204 that defines the toilet shell opening 212.

In FIG. 3, the hydraulic core 300 comprises a bowl 302/304 that is integrated with a siphon system 116 having a weir 124 and P-trap 116 that empties into a sewer line 122 (As shown in FIG. 1). The bowl 304 of the hydraulic core 300 further includes sealing surfaces 306/308 that mate with the toilet shell 210 sealing surfaces 206/208 to provide a water tight fit between the toilet shell 210 and the hydraulic core 300. The sealing surface 306/308 is generally disposed around the circumference of the top and/or side of the hydraulic core bowl 304, such that when the toilet shell 210 is fitted over the hydraulic core 300, the sealing surface 206/208 of the toilet shell and the sealing surface 306/308 of the hydraulic core fit together to form a watertight seal to prevent water from the hydraulic core from leaking through the mating sealing surfaces and into the space between the toilet shell and hydraulic core.

Figure 4:
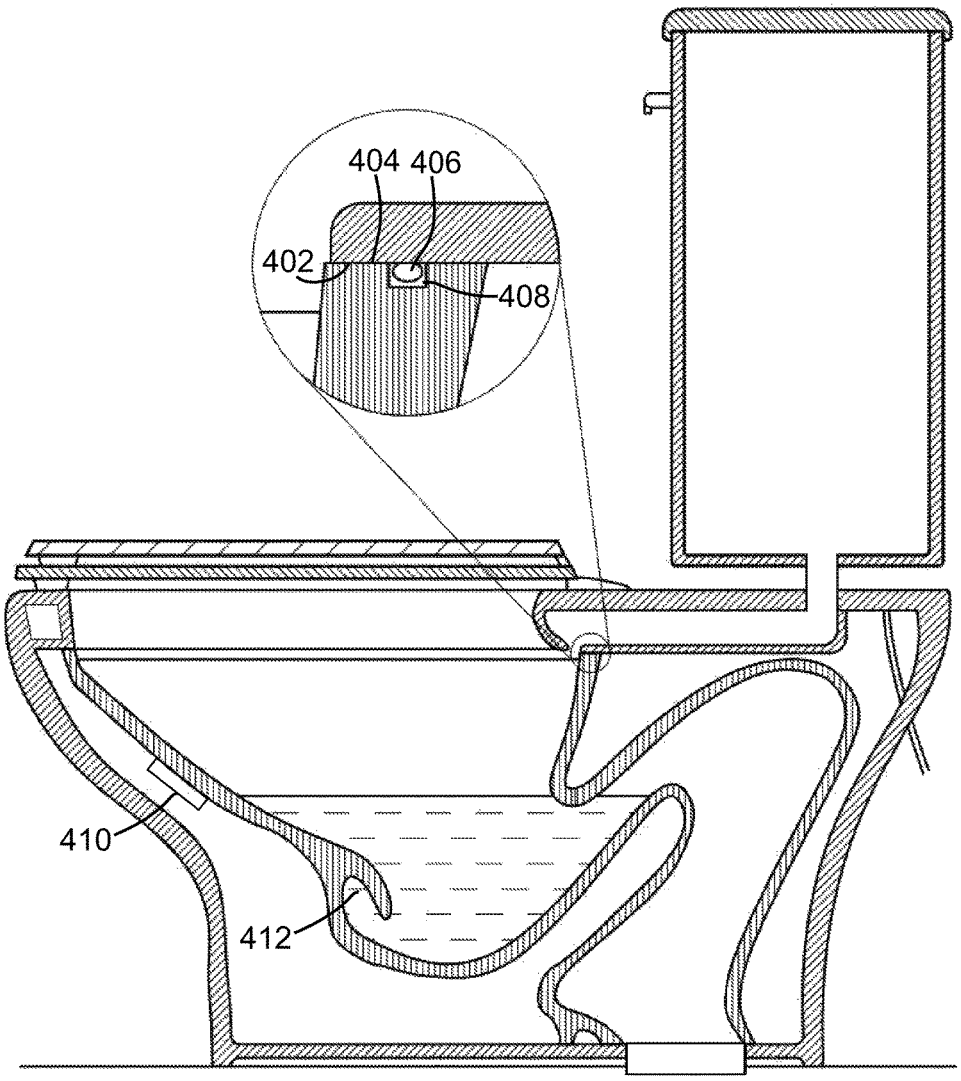
FIG. 4 is a side view of a hydraulic core within a toilet shell, with an exploded view of one configuration for sealing the hydraulic core and toilet shell.

FIG. 4 is a diagram of the toilet stool shell module and the toilet hydraulic core module as shown in FIGS. 2, 3 positioned together. Once joined together, the combined shell module and core module would include features as shown in FIG. 1. Additionally, after installation, the shell module could be removed from the core module for servicing or replacement and vice versa. Before or after assembly the modularity of this disclosure allows for the addition of features as disclosed herein that enhance the utility of the toilet beyond waste disposal.

In another aspect, FIG. 4 illustrates one possible structure for sealing the shell 210 and the hydraulic core 300. FIG. 4 shows the sealing surface 404 of the toilet shell and the sealing surface 402 of the hydraulic core fitted together to form a watertight seal. The sealing surface 402 of the hydraulic core is shown with a channel 408 within which is disposed a gasket 406, such as an O-ring, forming the watertight seal. Alternatively, the sealing surface 404 of the shell 210 may include a channel within which is disposed a gasket. The present invention contemplates other possible structures known to those skilled in the art for forming a watertight seal between the toilet shell 210 and the hydraulic core 300. A sensor 410 may be disposed on the wall of the bowl to aid in the operation of the toilet or in gathering data on a toilet user. The core 300 may also comprise a high-pressure jet 412 to assist the flush waste through the siphon.

Figure 5:
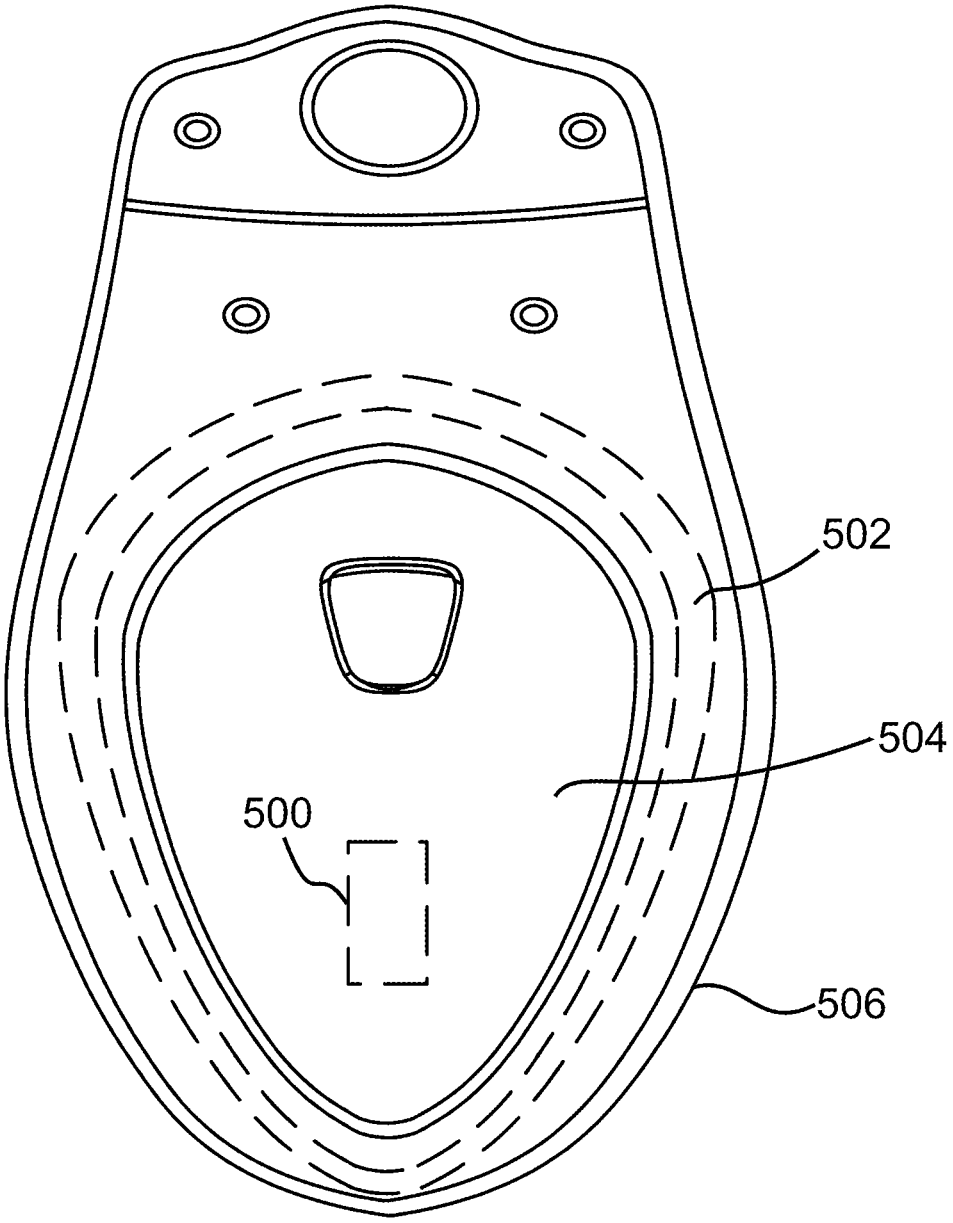
FIG. 5 is a top view of a toilet shell with hydraulic core with a sensor.

As shown in both FIG. 4 and FIG. 5, some embodiments of the present invention may also include one or more sensors 410 disposed on the hydraulic core 300, such that the sensor is capable of detecting and analyzing the contents of a user's waste products.

FIG. 5 is a top view of the toilet of the present invention as described herein. The figure depicts a toilet shell 506 and the bowl 504 of the hydraulic core. Sealing surfaces 502 are shown by the broken lines around a circumference of the shell and bowl. A sensor 500 is depicted on an exterior surface of the bowl. The sensor may be useful to gather data on the user of the toilet and to assist in the operation of the toilet, for example to detect a potential flooding event.

Figure 6:
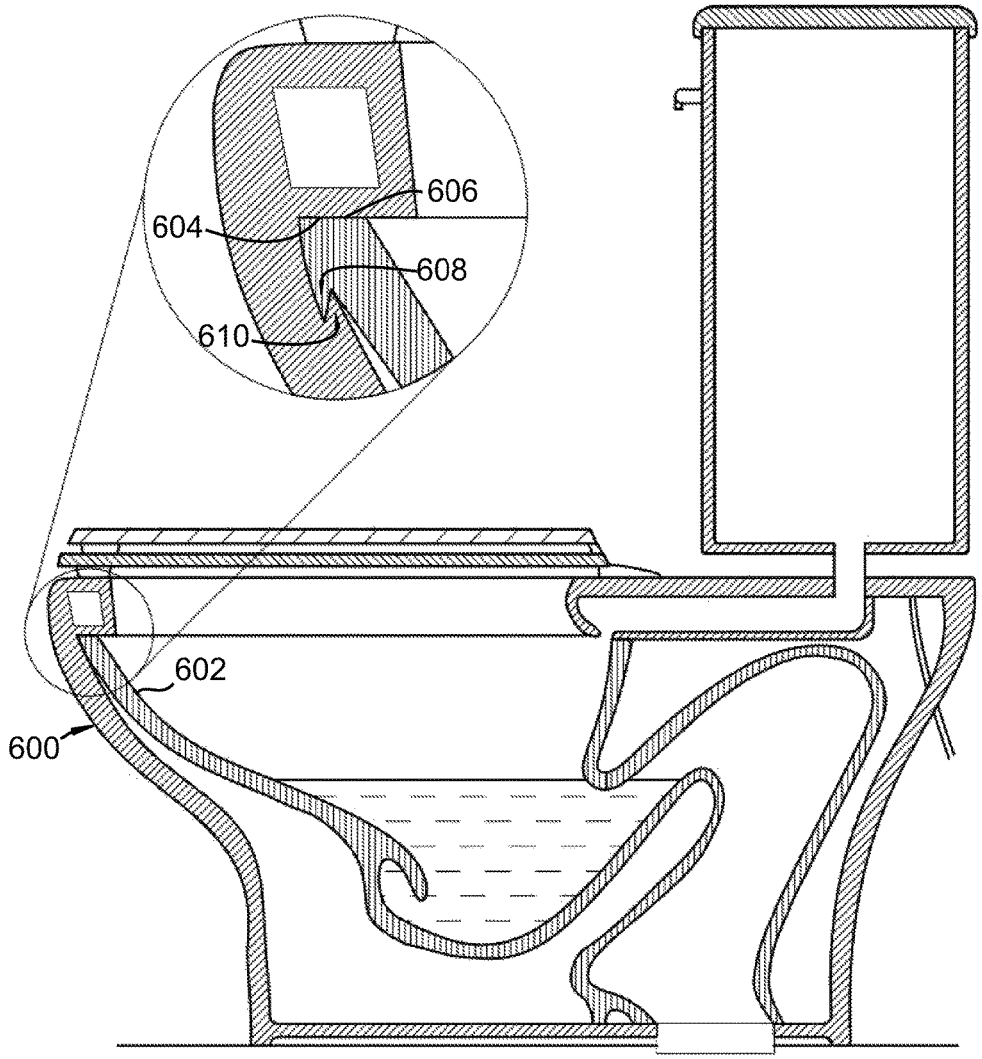
FIG. 6 is a side view of a hydraulic core and toilet shell sealing configuration.

In yet another aspect, FIG. 6 shows an embodiment of the present invention in which the hydraulic core bowl 602 comprises a lip 608 configured to mate with a channel 610 on an inner portion of the toilet shell 600. As shown in FIG. 6, the shell channel 610 comprises an acute angle shaped space and the hydraulic core lip 608 comprises a mating acute angle shaped protrusion, wherein the channel is configured to force the hydraulic core lip 608 upward toward the lower sealing surface 606 of the toilet shell such that the hydraulic core bowl seals with the toilet shell sealing surface along 604.

In another embodiment, FIG. 7 shows a discrete modular hydraulic core or circuit, comprising a looped drain. As shown, the discrete modular hydraulic circuit comprises a bowl 702 and a substantially vertical looped tubular drain 700. The first end of the drain 700 exits the bowl 702 and forms a loop comprising a crest 708. The axis of the substantially vertical loop runs generally parallel to the front-to-back length of bowl 702, or generally perpendicular to the side-to-side width of the bowl 702. As depicted the vertical loop 700 is a left-hand or counter-clockwise loop; alternatively, the vertical loop 700 may be a right-hand or clock-wise loop. A portion of the loop 700 may comprise a spiral, such as an Archimedean spiral. The diameter of spiral drain may comprise a varying helicity or a monotonic helicity. The drain may comprise a high-pressure jet 704 to assist in moving the contents of the bowl over the crest 708 of vertical loop to the second end of the drain 712. The vertical loop 700 may act as a siphon comprising a spillway 710 in removing the contents of the bowl 702 to the second end 712 adapted for connection to a sewer. The drain may comprise one or more ports 706. One of the ports 706 may intersect the drain at an angle of less than 90 degrees. The ports 706 may be connected to a hydraulic or pneumatic system. The tubular diameter of the vertical loop 700 may vary by approximately 20 to 50 percent or less in the direction of the sewer connection. One of the ports 706 may be used in combination with ventilation ducts to exhaust fumes from the toilet bowl and may be used as a bypass in the event of an obstruction in the looped drain 700. Also depicted is a sealing surface 714 around the circumference of the bowl 702.

The module toilet system of the present invention may include other features that contribute to its convenience and utility. For example, air passages (ventilation ducts) may be cast into the hydraulic core, as shown and described in U.S. Pat. No. 7,644,450. Starting at the ventilation inlet side, one or more bowl vent hole(s), such as a series of holes in a row, may be located high up at the back of the bowl but under the rim. These may join together and combine into one vent exhaust duct of and run upward so that any water entering the exhaust duct will drain back toward the bowl. After reaching the highest possible and practical point within the toilet bowl casting the exhaust duct will run downward to an exhaust duct outlet hole, which aligns with an intake hole of a blower unit, entering an airway of the blower unit at a somewhat downward angle, again to allow any water in the duct to drain. There should be no low cavities or pockets to trap water or any debris in the duct work such as the exhaust duct. A vent exit duct extends from an exit duct opening at the blower unit to the toilet drain duct near the bottom of the toilet base, and will generally be fairly short so as not to interfere with the flushing action of the toilet, perhaps 1 inch long more or less. It is also the same diameter, runs downward, and is free of water trapping pockets. The exit duct opening is aligned with a blower output hole which is the exit of the blower unit airway. Alternatively, it may be desirable to locate the components of the ventilation system inside the toilet shell module or inside the tank. The serviceable modules of this invention make that possible without having to replace the toilet.

Furthermore, the modular system of the present invention may further include an air venting system for removing noxious fumes, such as shown in U.S. Pat. No. 8,151,377, and as further disclosed in U.S. Provisional Patent Application No. 62/288,949, entitled Ventilated Toilet with P-Trap Flow Control, which is incorporated herein for all that it claims and teaches.

There is thus disclosed an improved toilet drain system. It will be appreciated that numerous changes may be made to the present invention without departing from the scope of the claims.

We claim:

1. A modular toilet system comprising:

a toilet shell, the toilet shell comprising a toilet shell opening and a first sealing surface;

a hydraulic core, the hydraulic core comprising a hydraulic core bowl and a siphon system, wherein the hydraulic core bowl comprises a hydraulic core bowl opening and a second sealing surface;

wherein the second sealing surface is configured to mate with the first sealing surface to form a water tight seal between the hydraulic core bowl and the toilet shell; and wherein the second sealing surface extends around a circumference of the hydraulic core bowl opening.

2. The modular toilet system according to claim 1, wherein the second sealing surface is positioned on an upper portion of the hydraulic core bowl.

3. The modular toilet system according to claim 1, wherein the first sealing surface is positioned on an upper portion of the toilet shell.

4. The modular toilet system according to claim 1, wherein the second sealing surface is horizontal.

5. The modular toilet system according to claim 1, wherein the toilet shell further comprises a channel, wherein the channel is disposed on an inner portion of the toilet shell, and wherein the hydraulic core bowl comprises a lip configured to mate with the channel.

6. The modular toilet system according to claim 5, wherein a gasket is disposed within the channel.

7. The modular toilet system according to claim 5, wherein the lip comprises an acute angle shaped protrusion and the channel comprises an acute angle shaped recess configured to force the lip upward toward a lower surface of the toilet shell such that the hydraulic core bowl seals with the toilet shell opening.

8. The modular toilet system according to claim 1, further comprising one or more sensors disposed within the hydraulic core bowl.

9. The modular toilet system according to claim 1, wherein the siphon system comprises a helical loop trap way, the helical loop trap way comprising substantially monotonic helicity.

10. A toilet shell comprising a toilet shell opening, wherein the toilet shell opening is defined by a sealing surface, wherein the sealing surface is configured to mate with a hydraulic core bowl to form a water tight seal between the toilet shell and the hydraulic core bowl.

11. The toilet shell according to claim 10, wherein the sealing surface is disposed on an underside of the toilet shell opening.

12. The toilet shell of claim 10, wherein the toilet shell further comprises a channel, wherein the channel is disposed on an inner portion of the toilet shell, wherein the channel comprises an acute angle shaped space, the space configured to receive a lip disposed on a hydraulic core and to force the lip upward toward a lower surface of the toilet shell such that the hydraulic core bowl seals with the toilet shell opening.

* * * * *